United States Patent [19]

Kubota

[11] Patent Number: 4,845,693

[45] Date of Patent: Jul. 4, 1989

[54] APPARATUS FOR CORRECTING A TIMEPIECE DISPLAY

[75] Inventor: Masaru Kubota, Shiojiri, Japan

[73] Assignee: Shiojiri Kogyo Kabushiki Kaisha, Tokyo, Japan

[21] Appl. No.: 252,956

[22] Filed: Oct. 3, 1988

[30] Foreign Application Priority Data

Oct. 2, 1987 [JP] Japan ..... 62-151453[U]

[51] Int. Cl.[4] ..... G04B 3/00; G04B 17/24

[52] U.S. Cl. ..... 368/185; 368/32; 368/190; 368/319

[58] Field of Search ..... 368/28, 31, 32, 34–37, 368/185, 187, 190–193, 319–321

[56] References Cited

U.S. PATENT DOCUMENTS 3,548,587 12/1970 Wood ..... 368/191
3,827,235 8/1974 Bachmann ..... 368/190
3,930,362 1/1976 Cielaszyk ..... 368/185
3,940,920 3/1976 Niznik ..... 368/185
4,408,896 10/1983 Ikegami ..... 368/185

*Primary Examiner*—Vit W. Miska
*Attorney, Agent, or Firm*—Blum Kaplan

[57] ABSTRACT

An apparatus for correcting a timepiece display includes a winding stem which extends within the timepiece and without the timepiece. The winding stem is movable from a normal carrying position to a first changing position. A convex region is formed on the winding stem. A sliding pinion is mounted about the stem. A first calendar correction operating wheel is loosely fit about the stem in the normal carrying position. The convex portion of the stem engages the first calendar correction operating wheel to provide a friction fit when the outside operating member is in the first step changing position to conduct date correction.

12 Claims, 5 Drawing Sheets

APPARATUS FOR CORRECTING A TIMEPIECE DISPLAY

BACKGROUND OF THE INVENTION

The present invention relates to an apparatus for correcting the display of a timepiece and, in particular, to a mechanism for correcting the time, day and date displays in an analog watch.

An apparatus for correcting a timepiece display is known in the prior art and includes a lever for setting the display which interacts with an outside operating member such as a watch stem. A yoke engages with the setting lever. A sliding pinion is moved to mesh with gear train members supported within the timepiece such as a setting wheel and a minute wheel to achieve time correction and also to mesh with a calendar correction operating wheel to effect date and day correcting. The sliding pinion is moved by the yoke so that the sliding pinion is moved to engage the teeth of the setting wheel and minute wheel in the gear train to perform time correction. On the other hand, to perform date and day correction, the pinion is slid to the opposite side so that it engages with the teeth of the calendar correction operating wheel.

The prior art apparatus for correcting a timepiece display has been less than satisfactory. The construction of the sliding pinion becomes extremely complicated thereby increasing the cost of manufacture. Additionally, because the sliding pinion is moved, some parts such as the yoke can not be removed thereby preventing the reduction of manufacture or repair costs.

Accordingly, it is desired to provide an apparatus for changing a timepiece display which overcomes the shortcomings of the prior art.

SUMMARY OF THE INVENTION

Generally speaking, in accordance with the present invention, an apparatus for changing a timepiece display includes an outside operating member including a stem which extends into the watch. A sliding pinion is mounted about the stem. A first calendar correction operating wheel is loosely fit about the stem when the stem is in the normal carrying position of the timepiece. The stem includes a convex portion which is selectively engagable by the sliding pinion so that the sliding pinion and the first calendar correction operating wheel engage with the stem when correcting the date and day display and loosely fit about the stem when in the normal carrying position.

Accordingly, it is an object of this invention to provide an improved apparatus for correcting a timepiece display.

It is another object of the invention to provide an apparatus for correcting the timepiece display in which the members of the changing mechanism such as the yoke can be removed while simplifying the construction of the sliding pinion.

Yet another object of the instant invention is to provide an apparatus for changing the timepiece display which results in a less expensive timepiece.

Still other objects and advantages of the invention will in part by obvious and in part will be apparent from the specification and drawings.

The invention accordingly comprises features of construction, combination of elements and arrangement of parts will be exemplified in the construction hereinafter set forth and the scope of the invention will be indicated in the claims.

BRIEF DESCRIPTION OF THE DRAWINGS

For a fuller understanding of the invention, reference is made to the following more detailed description taken in connection with the accompanying drawings, in which.

DETAILED DESCRIPTION OF THE PREFERRED EMBODIMENT

Figure 1:
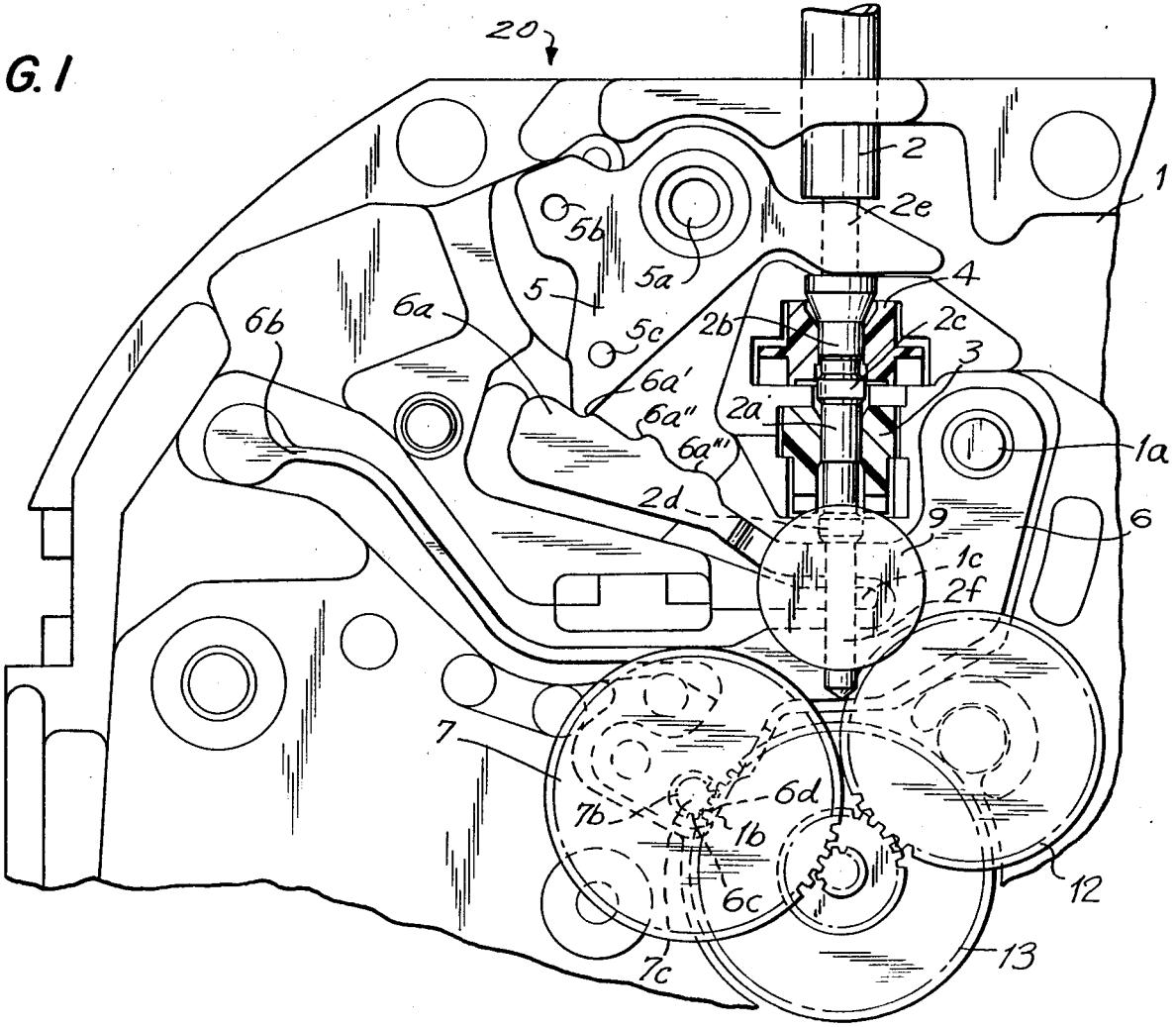
FIG. 1 is a partial top plan schematic view of a timepiece constructed in accordance with the invention in which the apparatus for correcting the display is in the normal carrying condition.
Figure 4:
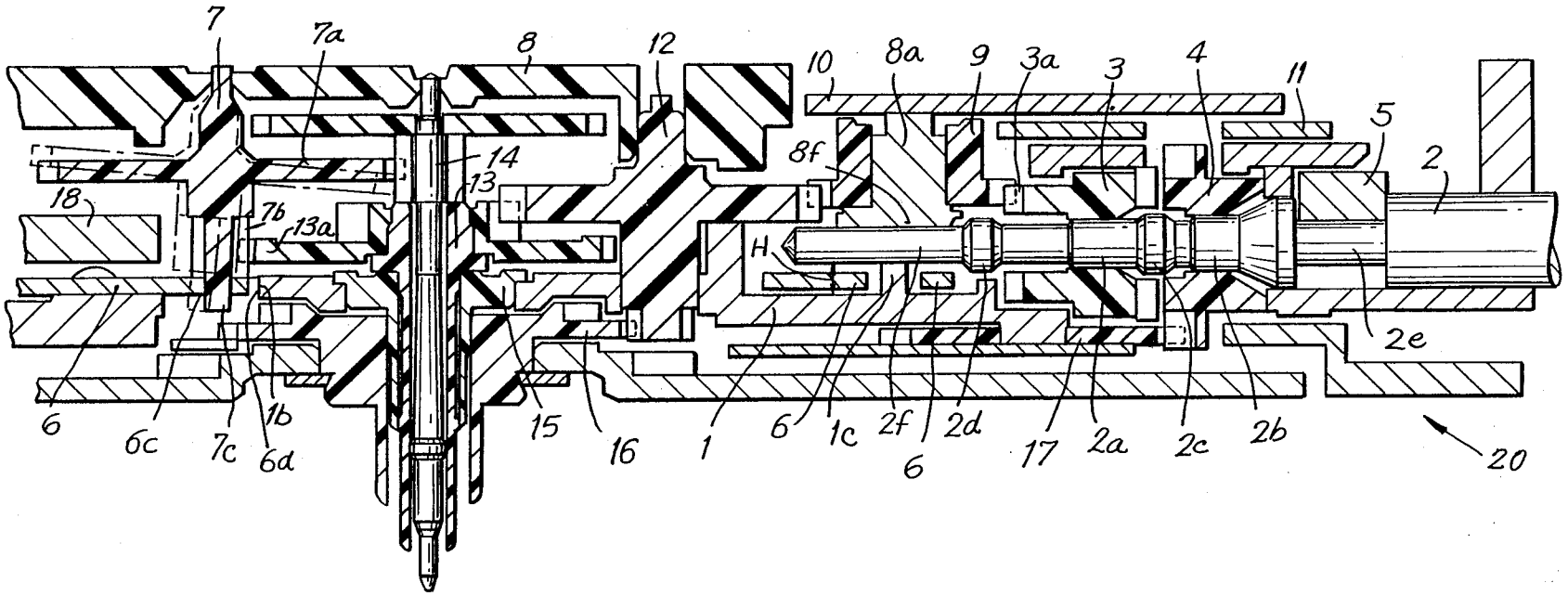
FIG. 4 is a cross-sectional view of the timepiece depicted in FIG. 1 in accordance with the invention when the apparatus for correcting the display is in the normal carrying condition.
Figure 5:
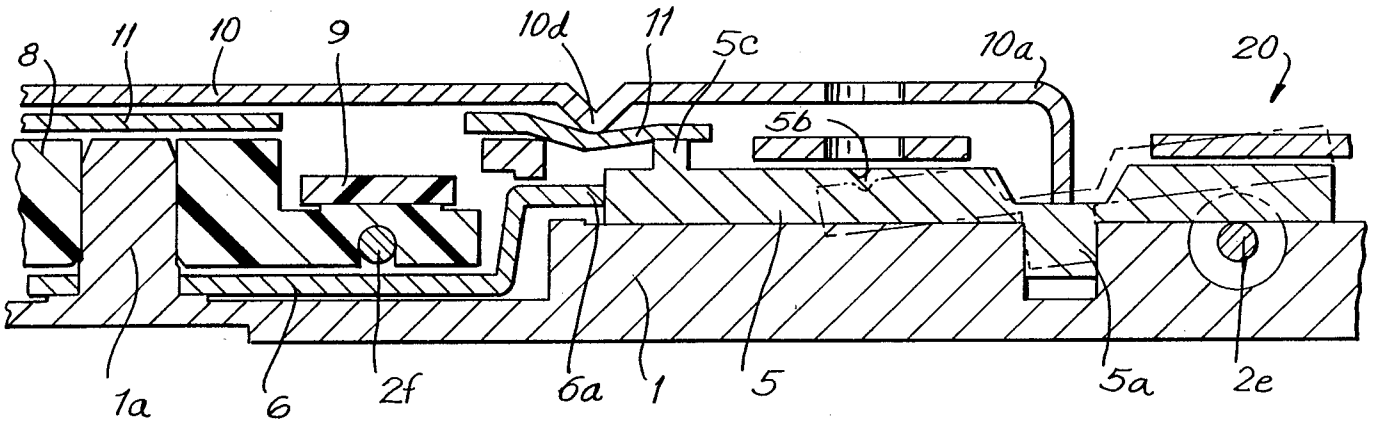
FIG. 5 is a cross-sectional view of another portion of the timepiece depicted in FIG. 1 in accordance with the invention when the apparatus for correcting the display is in the normal carrying condition.

Reference is first made to FIGS. 1, 4 and 5, wherein a timepiece, generally indicated at 20, constructed in accordance with the present invention, is provided. A plate 1 serves as a main frame of timepiece 20. A winding stem, generally indicated at 2 acts as an outside operating member. A sliding pinion 3 having a gear portion 3*a* is preferably made of plastic and loosely fits about winding stem 2 during the normal carrying (non-correction) condition. A first calendar correction operating wheel 4, also preferably made of plastic, loosely fits about winding stem 2.

An axis 5*a* extends from plate 1. A setting lever 5 integrally constructed about rotational axis 5*a* rotates thereabout. Winding stem 2 is formed with concave portions 2*a*, 2*b*. Concave portion 2*a* loosely fits within sliding pinion 3 while concave portion 2*b* loosely fits within first calendar correction operating wheel 4 when stem 2 is in the normal carrying condition. Setting lever 5 is positioned adjacent a concave portion 2*e* of winding stem 2 so that movement in winding stem 2 causes movement of setting lever 5. A convex portion 2*c* of winding stem 2 frictionally engages first calendar correction operating wheel 4 during date and day correction while a convex portion 2*d* of winding stem 2 frictionally engages sliding pinion 3.

An axis 1*a* extends from frame 1. A clutch plate 6 is mounted about axis 1*a* so that axis 1*a* acts as a rotational center to guide clutch plate 6. Clutch plate 6 is provided with a click portion 6*a* having distinct click regions 6*a*', 6*a*'' and 6*a*''' each of which may abut with setting lever 5. In accordance with the shape of click portion 6*a* of clutch plate 6, setting lever 5 is rotated as winding stem 2 is either pulled out or pushed in. In such a manner, clutch plate 6 holds the position of winding stem 2 and determines the operational force of winding stem 2 in accordance with shape of click portion 6*a*. Additionally, clutch plate 6 is provided with an elastic portion 6*b* which generates a force causing clutch plate 6 to rotate counterclockwise about plate axis 1*a*.

A third wheel and pinion 7 having a lower pivot 7*c* is positioned within a gear train guide holding hole 6*c* of clutch plate 6. Third wheel and pinion 7 is an integrally formed plastic member including a wheel 7*a* and pinion 7*b*. A portion 6*d* of clutch plate 6 abuts with plate dowel 1*b* in the vicinity of gear train guide holding hole 6*c* to determine the distance between the axis of a center wheel and pinon 13 and a third wheel and pinion 14 so that they mesh with each other smoothly.

A gear train bridge 8, formed as a single plastic piece, supported above plate 1 holds each wheel and pinion. A setting wheel 9, formed of a single plastic piece, is supported within a guide axis 8*a* and continuously meshes with gear portion 3*a* of sliding pinion 3. Setting wheel 9 rotates about guide axis 8*a* as a rotational center. Sliding pinion 3 is driven by setting wheel 9 even during a normal carrying condition and is also rotated upon the winding of stem 2. A concave portion 8*f* below axis 8*a* of setting wheel 9 guides tip portion 2*f* of winding stem 2 and guides winding stem 2 by securing it between a bearing portion 1*c* of plate 1 and concave portion 8*f* of gear train bridge 8. Winding stem 2 and plate 1 determine the looseness of clutch plate 6 in accordance with a step H formed between plate 1 and winding stem 2. The looseness of setting wheel 9 is determined by a supporting plate 10 which presses down upon the upper surface of axis 8*a* of gear train bridge 8. Supporting plate 10 is provided with a setting lever spring portion 10*a* for pressing down upon setting lever 5.

A circuit substrate 11 is maintained within timepiece by a convex portion 10d of supporting plate 10. A minute wheel 12 meshes with setting wheel 9 and center wheel and pinion 13. Center wheel and pinion 13 meshes with a fourth wheel and pinion 14. Center wheel and pinion 13 is attached to a minute hand and fourth wheel and pinion 14 is attached to a second hand. A center pipe 15 provides a connection path for center wheel and pinion 13 and fourth wheel and pinion 14 to the hands of the timepiece. An hour wheel 16 is supported about center pipe 15. A second calendar correction operating wheel 17 meshes with operating wheel 4. A stator 18 determines the looseness of clutch plate 6 in the vicinity of lower pinion 7*c* of third wheel and pinion 7 and is a conventional member of a motor for a timepiece. Center wheel 13 is mechanically linked to the motor so as to be driven thereby.

When timepiece 20 is in the normal carrying condition, sliding pinion 3 and first calendar correction operating wheel 4 are positioned by plate 1 and the wall of gear train bridge 8 respectively with a predetermined looseness. Sliding pinion 3 is loosely fit about winding stem 2. Setting lever 5 engages click portion 6*a*′ of clutch plate 6 thereby securely abutting plate dowel 1*b* against abutting portion 6*d* of clutch plate 6. Therefore, center wheel 13*a* and third wheel and pinion 7*b* mesh with an appropriate center distance therebetween. The remaining members such as gear train bridge 8 and the display changing portion such as lever 5 perform no movement.

Figure 2:
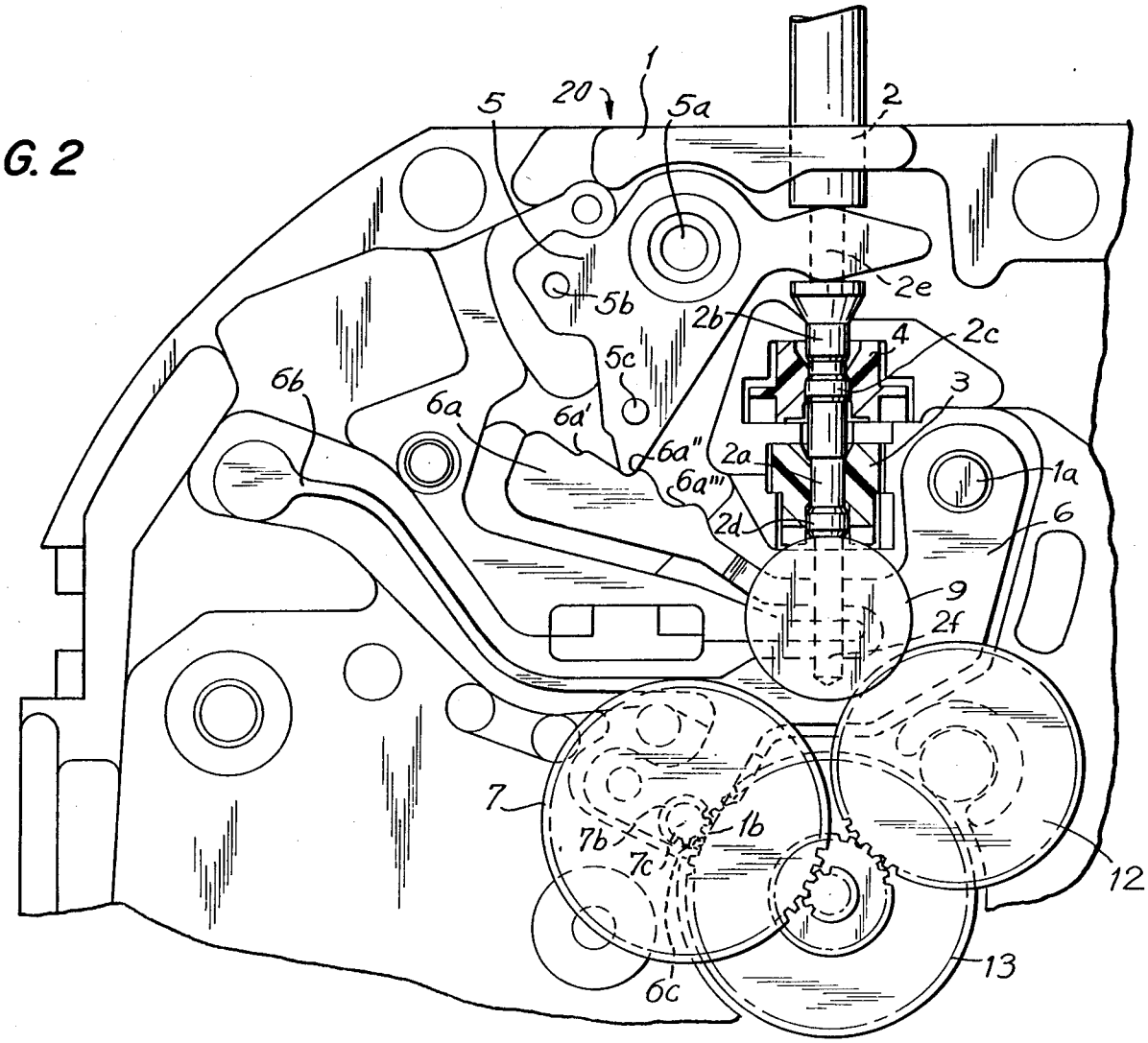
FIG. 2 is a partial top plan schematic view of a timepiece in accordance with the instant invention in which the apparatus for correcting the display is in a condition of date and day correction.

Reference is now made to FIG. 2 in which the date and day correcting condition is described. When winding stem 2 is drawn from a normal carrying condition, setting lever 5 rotates as concave portion 2*e* which is in contact with setting lever 5 is moved. Accordingly, setting lever 5 and winding stem 2 are positioned at a next location by shifting setting lever 5 to the next recess portion 6*a*″ of click portion 6*a* of clutch plate 6 which corresponds to a first changing step position. Abutting portion 6*d* of clutch plate 6 now remains abutted against plate dowel 1*b* and center wheel 13*a* meshes with third wheel and pinion 7*b* with an appropriate center distance therebetween. Additionally, when winding stem 2 is in this position, the first changing step position, convex portion 2*c* of winding stem 2 frictionally engages first calendar correction operating wheel 4 which has previously been loosely fit about concave portion 2*b*. A rotational force applied to winding stem 2 generated by the rotating operation from outside the timepiece is now transmitted to first calendar correction operating wheel 4 and second calendar correction operating wheel 17, thereby correcting the date and day through conventional gear train structure. Additionally, sliding pinion 3 now loosely fits about concave portion 2*a* of winding stem 2 in the same way as in the normal carrying condition to maintain a free condition for sliding pinion 3.

Figure 3:
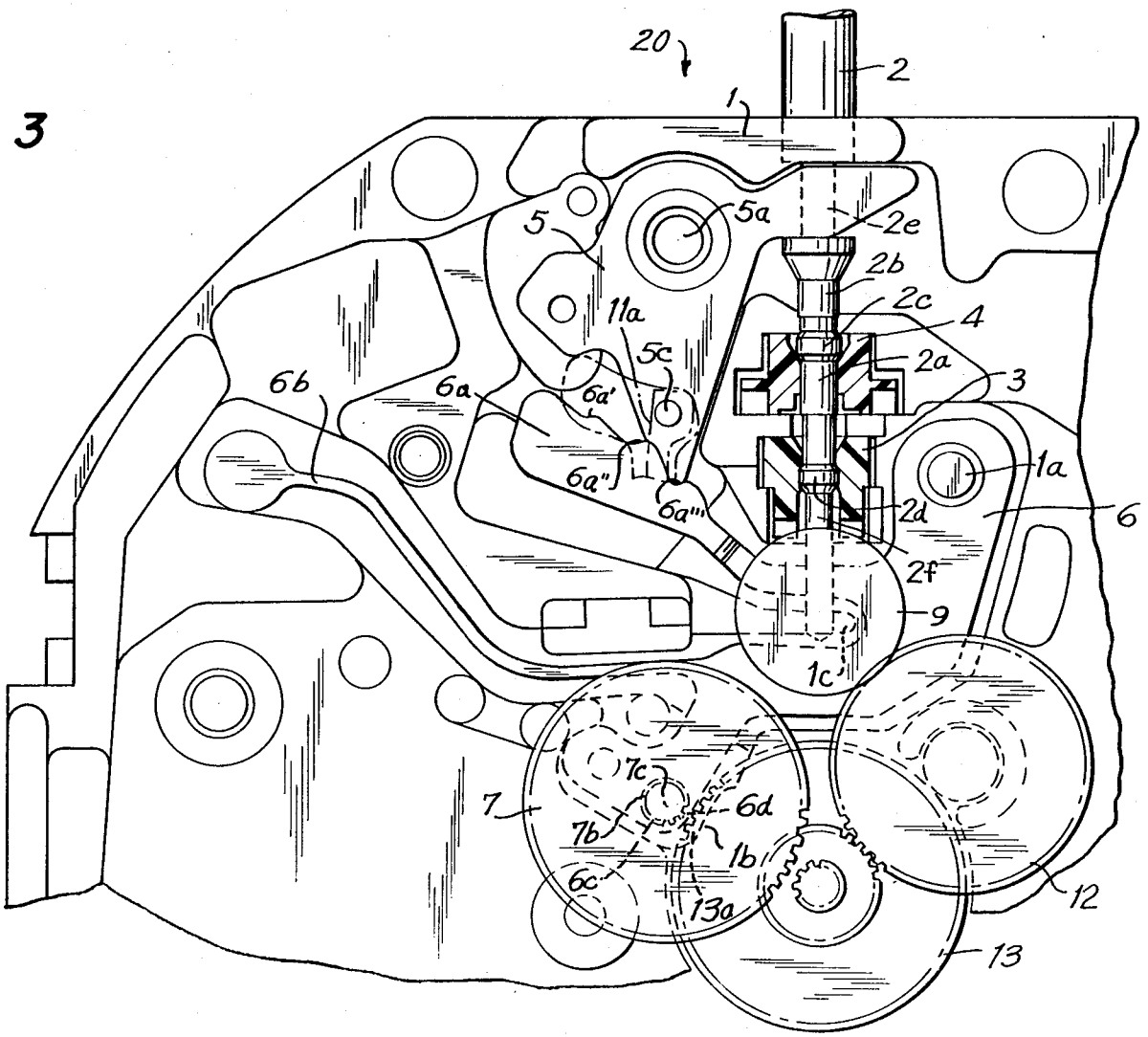
FIG. 3 is a partial top plan schematic view of timepiece constructed in accordance with the invention in which the apparatus for correcting the timepiece display is in a condition for correcting the time.

Reference is next made to FIG. 3 in which the time correcting condition is described. Winding stem 2 is further drawn out, setting lever 5 is rotated further in the manner as described above. Setting lever 5 and winding stem 2 are positioned at the next location by the shifting of setting lever 5 to recess 6*a*‴ of click portion 6*a* of clutch plate 6, the second changing step position. As click spring portion 6*a* of clutch plate 6 is moved following setting lever 5, clutch plate 6 rotates clockwise about dowel 1*a* due to a reaction force of elastic portion 6*b*. Abutting portion 6*d* which maintains the appropriate center distance between center wheel and pinion 13 and third wheel and pinion 14 during the first changing step moves out of engagement with plate dowel 1*b* to move gear train guide holding hole 6*c*, thereby moving center wheel 13*a* out of engagement with third wheel and pinion 7*b*.

When winding stem 2 is in the second changing step position, sliding pinion 3 which has been previously loosely fitted about concave portion 2*d* of winding stem 2 now frictionally engages convex portion 2*d*. Rotational forces of winding stem 2 generated by rotating winding stem 2 from the outside of the timepiece are transmitted to sliding pinion 3 which rotates center wheel and pinion 13 and hour wheel 16 through setting wheel 9 and minute wheel 12 thereby conducting time correction. A minute hand and hour hand are respectively attached to center wheel and pinion 13 and hour wheel 16.

On the other hand, first calendar correction operating wheel 4 is constructed so that it now is out of engagement with convex portion 2*c* of winding stem 2 with which it had previously been frictionally engaged during the first changing step position. First calendar correction operating wheel 4 loosely fits about concave portion 2*a* allowing free rotation thereabout. Date and day correcting is prevented from occurring even though winding stem 2 is rotated to correct the time display. Furthermore, due to the engagement of dowel 5*c* provided at setting lever 5 and a reset pattern 11*a*, resetting is conducted.

Thus, by constructing a display correcting apparatus as described above, a sliding mechanism on the gear train portion is no longer required due to the movement of the center wheel out of engagement with the third wheel so that rotational torque load necessary during time correcting is removed. Therefore although the gear train portion, especially the gear train member utilized during time correcting, have been previously made of metallic members, all the gear train members can now be made of plastic resulting in a simple manufacturing process at a reduced cost of parts.

Additionally, because the click portion is integrally formed with the clutch plate, a smoothly operating display changing mechanism is obtained. The setting lever now moves out of engagement with the click portion of the clutch plate and becomes free so that attachment and detachment of the winding stem may be achieved without affecting other members of the changing mechanism by merely depressing a recess 5b provided at the tail portion of the setting lever. Additionally, the clutch plate engages with the setting lever at the click portion and the spring portion to produce a force for operating the winding stem while holding and guiding a portion of the gear train member. Accordingly, time correcting through a stable operating force of the winding stem may be conducted under a no load condition by attachment and detachment of a part of the gear train during time correcting. As a result, all of the gear train members can be made of plastic thereby providing an inexpensive timepiece body.

The above described embodiment relates to a frictional engagement during correcting of the display provided by the sliding pinion and the first calendar correction operating wheel. Correcting may also be conducted by an engagement of the sliding pinion having a rectangular hole or a first calendar correction operating wheel having an angle cut winding stem. The axis of the setting wheel which is integrally formed with the gear train is employed in this embodiment, but a member such as a sweep second clock hand of the gear train can also be employed. Additionally, the construction or attaching/detaching of the third wheel lower pivot utilizing the clutch plate and the setting lever is shown in this embodiment. However, a correcting method with a slide mechanism is equally applicable. Furthermore, the gear train portion in this embodiment is attached or detached by operating the third wheel lower pivot. However, it also may be achieved by operating both the upper and lower pivots simultaneously or only the upper pivot.

Although the present embodiment is directed to both calendar correction operating wheel 4 and sliding pinion 3, it is equally operable with a vertical convex portion which elastically engages only with the calendar correction operating wheel.

By providing a timepiece in which a sliding pinion engages with a convex portion of the winding stem, the winding stem acting as an outside operating member while the time correcting and first calendar correction operating wheel engage with the convex portion during date and day correcting, a simplified structure is provided. Furthermore, by providing a sliding pinion and a first calendar correction operating wheel loosely fitted about the convex portion of the stem, the calendar correction operating wheel sits freely about the convex portion during normal carrying and other conditions. Therefore, date and day correcting and time correcting may be conducted with fewer parts and a gear train member for changing the display can be made of plastic having simple configurations. This results in an inexpensive timepiece body.

It will thus be seen that the objects set forth above, among those made apparent from the preceding description are efficiently obtained and, some certain changes may be made in the construction set forth without departing from the spirit and scope of the invention, it is intended that all matter contained in the above description and shown in the accompanying drawings shall be interpreted as illustrative and not in the limiting sense.

It is also to be understood that the following claims are intended to cover all the generic and specific features of the invention herein described and all statements of the scope of the invention which as a matter of language might be said to fall therebetween.

What is claimed is:

1. An apparatus for correcting a timepiece display in a timepiece having a housing, said timepiece having a time display and a date display comprising:

an outside operating member, including a shaft extending within and without said housing, said shaft being selectively movable from a normal carrying position to a first step changing position, said shaft having a convex portion formed a sliding pinion guiding said outside operating member; and a first calendar correction operating wheel, said sliding pinion and said first calendar correction operating wheel being loosely fit about said outside operating member when the outside operating member is in the normal carrying position, the convex portion of the outside operating member engaging with said first calendar correction operating wheel to provide a friction fit between the outside operating member and the sliding pinion when the outside operating member is in the first step changing position whereby date correcting is conducted.

2. The apparatus for correcting a timepiece display of claim 1, wherein said outside operating member is selectively movable to a second step changing position where said first calendar correction operating wheel loosely fits about said outside operating member and said sliding pinion engages the convex portion to form a friction fit therebetween whereby rotation of the outside operating member causes correcting of the time display.

3. The apparatus for correcting a timepiece display of claim 1, further comprising a center wheel to which a power driving source is transmitted, a minute wheel meshing with said center wheel, and a setting wheel meshing with the minute wheel, said setting wheel meshing with said sliding pinion when said outside operating member is in the normal carrying position.

4. The apparatus for correcting a timepiece display of claim 2, further comprising a center wheel to which a power driving source is transmitted, a minute wheel which meshes with said center wheel, and a setting wheel which meshes with the minute wheel, said setting wheel meshing with said sliding pinion when said outside operating member is in the normal carrying position.

5. The apparatus for correcting a timepiece display of claim 1, wherein said sliding pinion and first calendar correction operating wheel are made of plastic.

6. The apparatus for correcting a timepiece display of claim 2, wherein said sliding pinion and first calendar correction operating wheel are made of plastic.

7. The mechanism for correcting a timepiece display of claim 3, wherein said sliding pinion, setting wheel and first calendar correction operating wheel are made of plastic.

8. The mechanism for correcting a timepiece display of claim 1, further including positioning means for maintaining the outside operating member in the first step changing position.

9. The mechanism for correcting a timepiece display of claim 8, wherein the positioning means includes a setting lever, the setting lever engaging the stem and a clutch plate having a click portion, the setting lever abutting the click portion of the clutch plate.

10. The mechanism for correcting a timepiece display of claim 2, further including positioning means for maintaining the outside operating member in one of the first step changing position and second step changing position.

11. The mechanism for correcting a timepiece display of claim 10, wherein the positioning means includes a setting lever, the setting lever engaging the stem and a clutch plate having a click portion, the setting lever abutting the click portion of the clutch plate.

12. The mechanism for correcting a timepiece display of claim 11, wherein the click portion includes a first click region, a second click region, and a third click region, the setting lever abutting the second click region in the first step changing position and abutting the third click region in the second step changing position.

* * * * *